US005182883A

United States Patent [19]

Amberson et al.

[11] Patent Number: 5,182,883

[45] Date of Patent: Feb. 2, 1993

[54] TELEPHONE ENCLOSURE

[75] Inventors: James R. Amberson, Richfield; William C. Ehlert; George E. Olson, both of Minneapolis, all of Minn.

[73] Assignee: Armco Inc., Middletown, Ohio

[21] Appl. No.: 660,341

[22] Filed: Feb. 22, 1991

[51] Int. Cl.[5] ..... E04H 1/14

[52] U.S. Cl. ..... 52/73; 52/27; 52/28; 52/36; 52/38; 52/788; 52/790

[58] Field of Search ..... 52/27, 28, 36, 38, 656, 52/475, 788, 790, 73

[56] References Cited

U.S. PATENT DOCUMENTS

| | | | |
|---|---|---|---|
| D. 189,129 | 11/1960 | Turner . | |
| D. 197,215 | 12/1963 | Dreyfuss . | |
| D. 212,081 | 8/1968 | Dreyfuss . | |
| D. 221,629 | 8/1971 | King . | |
| D. 260,702 | 9/1981 | Hannuia et al. . | |
| D. 300,093 | 3/1989 | Ranz et al. . | |
| 2,589,064 | 3/1952 | Drake | 52/788 |
| 2,804,954 | 9/1957 | Gillespie | 52/788 |
| 3,359,691 | 12/1967 | Sherron | 52/28 |
| 3,389,522 | 6/1968 | Hordis | 52/790 |
| 4,410,930 | 10/1983 | Yachabach . | |
| 4,429,502 | 2/1984 | Kinnebrew | 52/656 |
| 4,432,170 | 2/1984 | Heweli . | |
| 4,706,399 | 11/1987 | Martin . | |
| 4,754,582 | 7/1988 | Cameron . | |
| 4,886,561 | 12/1989 | Rohweder et al. | 52/790 |
| 4,961,294 | 10/1990 | Cameron | 52/27 |

FOREIGN PATENT DOCUMENTS

| | | | |
|---|---|---|---|
| 2555647 | 5/1985 | France | 52/656 |

OTHER PUBLICATIONS

Copy of an AT&T Brochure on the Silencer Telephone Enclosure.

*Primary Examiner*—David A. Scherbel
*Assistant Examiner*—Wynn E. Wood
*Attorney, Agent, or Firm*—Webb, Burden, Ziesenheim & Webb

[57] ABSTRACT

A telephone enclosure including curved sidewalls each having an outer panel, an inner panel, an acoustic panel and a body rail assembly. The body rail assembly comprises a plurality of rails, each of which have depending legs to receive the inner panel, outer panel and acoustic insulation panel. The enclosure further includes a back panel having one end mounted to the sidewalls, which together horizontally cover at least 180°, leaving an open front access to the enclosure. A support base mounts to another end of the post and a device for receiving a telephone. Further, the enclosure includes a ceiling assembly mounted to the housing assembly. The ceiling assembly includes spaced apart ceiling plates, a ceiling rail arrangement having a plurality of legs defining ceiling panel receiving slots to receive a translucent panel. The ceiling includes a light source to illuminate the translucent panel and the interior of the panel assembly. A shelf mounts to the sidewalls.

20 Claims, 12 Drawing Sheets

TELEPHONE ENCLOSURE

FIELD OF THE INVENTION

This invention relates to telephone enclosures and, more particularly, telephone enclosures having acoustic housings for indoor and outdoor use.

DESCRIPTION OF THE PRIOR ART

Telephone enclosures having acoustic housings for indoor and outdoor use are known in the art. Such telephone enclosures are shown in U.S. Pat. Nos. 4,706,399; 4,410,930; 4,432,170; Des. 189,129, Des. 260,720, and Des. 300,093, for example. Typically, these enclosures are rather bulky and require two individuals to assemble and repair the enclosures on site.

Many of the enclosures have a three-panel construction which includes a perforated inner panel, an acoustic insulation middle panel and an outer panel. The outer panel usually includes some form of signage. At times, one or more of these panels must be replaced, because of vandalism, for example. Presently, replacement of these panels is a time-consuming operation and usually requires two individuals for several reasons. First, the panels can be heavy and awkward to handle. Thus, when replacing one panel, one person must hold in place the panels which are not replaced while the other person replaces the panel. This is to prevent damage to the unreplaced panels from falling out of the enclosure and injuring the repairman. Second, the panels are usually held in place by a rail assembly. When replacing a panel, the rail assembly must be disassembled. After the panel is replaced, usually one individual is required to realign the panels in the rail assembly while the individual reassembles the rail assembly.

Therefore, it is an object of the invention to provide a telephone enclosure which can easily be assembled and repaired by one individual. Further, it is an object of the invention to provide an inexpensive telephone enclosure.

SUMMARY OF THE INVENTION

The invention is a telephone enclosure including an acoustic housing having an inner panel, an outer panel, an acoustic insulation panel and a body rail assembly. The body rail assembly includes a first rail having a first rail base with an integral first leg, an integral second leg, an integral third leg and an integral fourth leg depending therefrom. The first leg is positioned in spaced relation to the second leg and defines a first rail inner panel receiving slot therebetween. The third leg is positioned in spaced relation to the fourth leg and defines a first rail outer panel receiving slot. The inner panel is slideably received by the first rail inner panel receiving slot. Likewise, the outer panel is slideably received by the outer panel receiving slot. The first rail also has a first rail insulation receiving step which is integral to and depends from the first rail base. The step is positioned between the second leg and the third leg. A first recess is defined between the second leg and the first rail step and a second recess is defined between the first rail step and the third leg. A first edge of the insulation panel abuts against the step. A first air gap is defined between the inner panel and the insulation panel and the second air gap is defined between the insulation panel and the outer panel.

The body rail assembly can further include a second rail having a top rail base with an integral fifth leg, and integral sixth leg, an integral seventh leg and an integral eighth leg depending toward the first rail. The fifth leg is positioned in spaced relation to the sixth leg and defines a second rail inner panel receiving slot therebetween. The seventh leg is positioned in spaced relation to the eighth leg and defines a second rail outer panel receiving slot. The inner panel is slideably received by the second rail inner panel receiving slot. Likewise, the outer panel is slideably received by the second rail outer panel receiving slot. The first rail inner panel receiving slot is positioned across from the second rail inner panel receiving slot. The first rail outer panel receiving slot is positioned across from the second rail outer panel receiving slot. The first rail also includes a second rail insulation receiving step integral to and depending from the base. The second rail step is positioned between the sixth leg and the seventh leg. A third recess is defined between the sixth leg and the step and a fourth recess is defined between the step and the seventh leg. The first rail step is positioned across from the second rail step. A second edge of the insulation panel abuts the second rail step.

The body rail assembly can also include a third rail having a third rail base with an integral ninth leg, an integral tenth leg, an integral eleventh leg, and an integral twelfth leg depending therefrom. The ninth leg is positioned in spaced relation to the tenth leg and defines a third rail inner panel receiving slot therebetween. The eleventh leg is positioned in spaced relation to the twelfth leg and defines a third rail outer panel receiving slot. The inner panel is slideably received by the third rail inner panel receiving slot. The outer panel is slideably received by the third rail outer panel receiving slot. A first end of the third rail attaches to a first end of the second rail and a second end of the third rail attaches to a first end of the first rail. Screw ports are defined by the tenth leg and eleventh leg. Each screw port can include a first arcuate shaped member integral with the tenth leg and a second arcuate shaped member integral with the eleventh leg. The first member faces the second member, and the first member and the second member define an insulation panel edge receiving recess which receives a third edge of the insulation panel. The first member and the second member may be C-shaped.

The body rail assembly can further include a fourth rail having a fourth rail base with an integral thirteenth leg, an integral fourteenth leg, an integral fifteenth leg and an integral sixteenth leg depending therefrom. The thirteenth leg is positioned in spaced relation to the fourteenth leg and defines a fourth rail inner panel receiving slot therebetween. The fifteenth leg is positioned in spaced relation to the sixteenth leg and defines a fourth rail outer panel receiving slot. The inner panel is slideably received by the fourth rail inner panel receiving slot. The outer panel is slideably received by the fourth rail outer panel receiving slot. The fourth rail also includes a fourth rail insulation receiving step which is integral to and depends from the fourth rail base. The fourth rail step is positioned between the fourteenth leg and the fifteenth leg. A fifth recess is defined between the fourteenth leg and the fourth rail step. A sixth recess is defined between the fourth rail step and the fifteenth leg. A fourth edge of the insulation panel abuts against the fourth rail step. The fourth rail has a first end and a second end where the first end of the fourth rail attaches to a second end of the second rail and a second end of the fourth rail attaches to a second end of the first rail.

The first leg, fourth leg, fifth leg, eighth leg, ninth leg, twelfth leg, thirteenth leg and sixteenth leg can all have a first height and the remainder of the legs can have a second height where the second height is greater than the first height. Further, the first group of these legs can have beveled tips while the second group of these legs can have rounded tips.

The insulation panel can be made of fiberglass or acoustic foam material. The inner panel can have a plurality of perforations and be made of stainless steel. The outer panel is preferably made of a metal such as aluminum or stainless steel.

The phone enclosure can further include a post having one end mounted to the housing assembly, a support base mounted to another end of the post, a device for receiving a telephone and a ceiling assembly mounted to the housing assembly.

The ceiling assembly can include a first ceiling rail and a second ceiling rail. The second ceiling rail has a first ceiling rail base, an integral seventeenth leg, and a spaced integral eighteenth leg both depending from the rail base. A first ceiling panel receiving slot is defined between the seventeenth leg and the eighteenth leg. The second ceiling rail is positioned across from the first ceiling rail and includes a second ceiling rail base, an integral nineteenth leg and a spaced integral twentieth leg both depending from the second ceiling base toward the first ceiling rail. A second ceiling panel receiving slot is defined between the nineteenth and the twentieth leg. The ceiling assembly further includes a removable translucent roof panel that has a first edge received by the first slot and a second edge slideably received by the second slot.

The ceiling assembly can further include a top plate attached to the second ceiling rail and a bottom plate attached to the first ceiling rail. A first sealing ring can be sandwiched between the top plate and the first ceiling rail and a second sealing ring can be sandwiched between the bottom plate and the second ceiling rail. Appropriate sealing ring grooves can be included in respective first ceiling rail and second ceiling rail for receiving the first sealing ring and the second sealing ring. The sealing ring can be V-shaped. The ceiling assembly can further include a light source. Further, the ceiling assembly and the acoustic housing can be arcuate shaped.

Furthermore, the first end and second end of the second rail, the first end and the second end of the third rail, the first end of the fourth rail and the first end of the first rail can all have complementary mitred edges. The second end of the fourth rail and the second end of the first rail have complementary flat edges. The first rail can be L-shaped having a first section and a depending second section.

Furthermore, the invention includes a telephone enclosure having a back panel, curved sidewalls attached to the back panel which, together with the panel, horizontally cover at least 180°, leaving an open front access to the enclosure. A ceiling assembly attaches to the sidewalls where the ceiling assembly includes a substantially circular top plate and a substantially circular bottom plate spaced vertically from the top plate. The plates form a compartment therebetween. A light source is positioned within the compartment, and an opening in the bottom plate permits light to pass from the top enclosure to the main interior of the telephone enclosure formed by the curved sidewalls. The sidewalls can be substantially the same as the previously described inner panel-outer panel arrangement.

The ceiling assembly can include further a first ceiling rail attached to the bottom plate and a second ceiling rail attached to the top plate which slideably receives a removable translucent panel having a first edge slideably received by a first ceiling panel receiving slot and a second edge slideably received by a second ceiling panel receiving slot. The first rail includes a first leg and a second leg wherein the first ceiling panel receiving slot is formed therebetween, and the second rail has a third leg and a fourth leg wherein the second ceiling panel receiving slot is formed therebetween. A diffuser separator can attach to the first ceiling rail and the second ceiling rail abutting against an end of the translucent roof panel. The diffuser panel can include a segment having an integral first plate received between the first leg and the second leg, and an integral second plate received between the second leg and the fourth leg, wherein the panel abuts against the first plate. The diffuser separator can be C-shaped.

The telephone enclosure can further include a stainless steel shelf attached between the sidewalls and the support post. A curved shelf supporting channel is positioned between the inner panel and the outer panel of the side walls, and fasteners passing through the inner panel attach the shelf to the channel. The channel can have a C-shaped cross section having two legs and a base. The legs abut against the outer panel and the base abuts against the inner panel. Further, a plurality of blocks can be attached to the outer panel and received between the channel legs so that the channel is welded to the blocks.

DESCRIPTION OF THE PREFERRED EMBODIMENT

Figure 1:
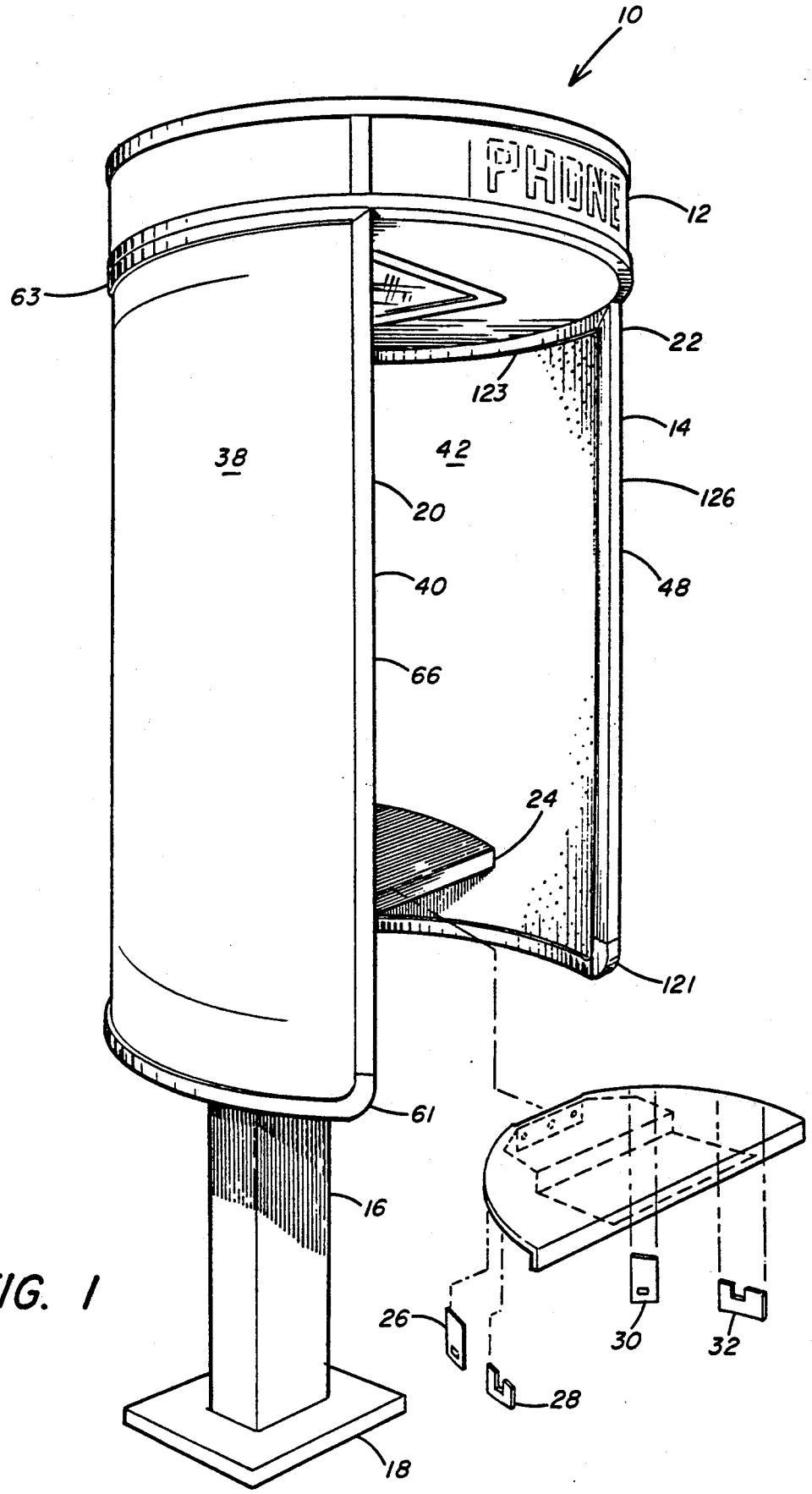
FIG. 1 shows a partially exploded perspective view of a telephone enclosure made in accordance with the present invention.
Figure 2:
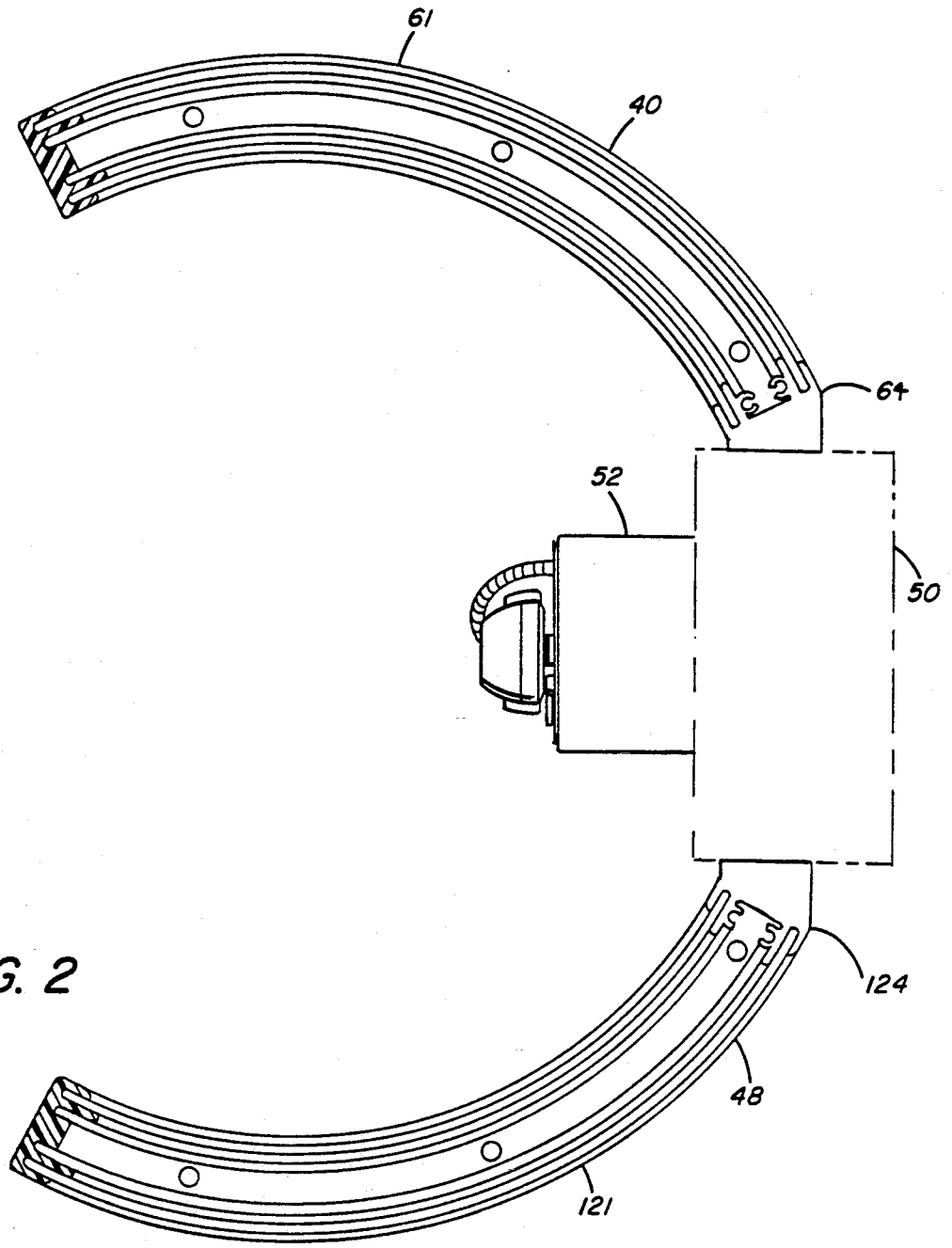
FIG. 2 shows a top view partially in section of a portion of a rail assembly of the telephone enclosure.

FIG. 1 shows a telephone enclosure 10 made in accordance with the present invention. The phone enclosure 10 includes an illuminated ceiling assembly 12, and a body 14 attached to the ceiling assembly 12. The body 14 of the enclosure 10 attaches to a support post 16 and a support base 18 attaches to the support post 16. The particular geometrics of the support post 16 depend on the particular type of telephone installed. The body includes curved sidewalls, specifically, a first arcuate shaped panel assembly 20 and the second arcuate shaped panel assembly 22 which, together with the post 16, cover at least 180°, leaving an open access to the enclosure. A shelf assembly 24 mounts to lower portions of the first panel assembly 20 and second panel assembly 22 by mounting hardware 26, 28, 30 and 32. As shown in FIG. 2, respective sections of the first panel assembly 20 and second panel assembly 22 are mounted to a back panel 50. A telephone 52 attaches to the support post 16. The body 14 and the ceiling assembly 12 form a somewhat cylindrical enclosure around the telephone 52.

Figure 4:
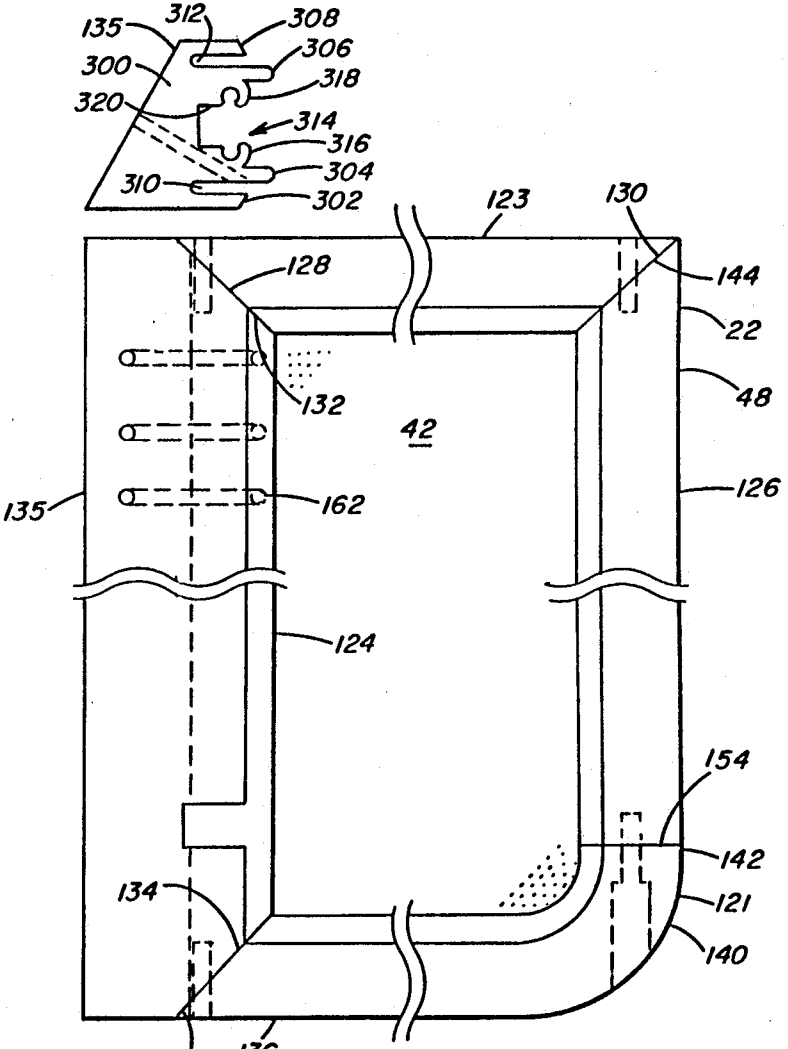
FIG. 4 shows a side view of a second panel assembly of the telephone enclosure.
Figure 5:
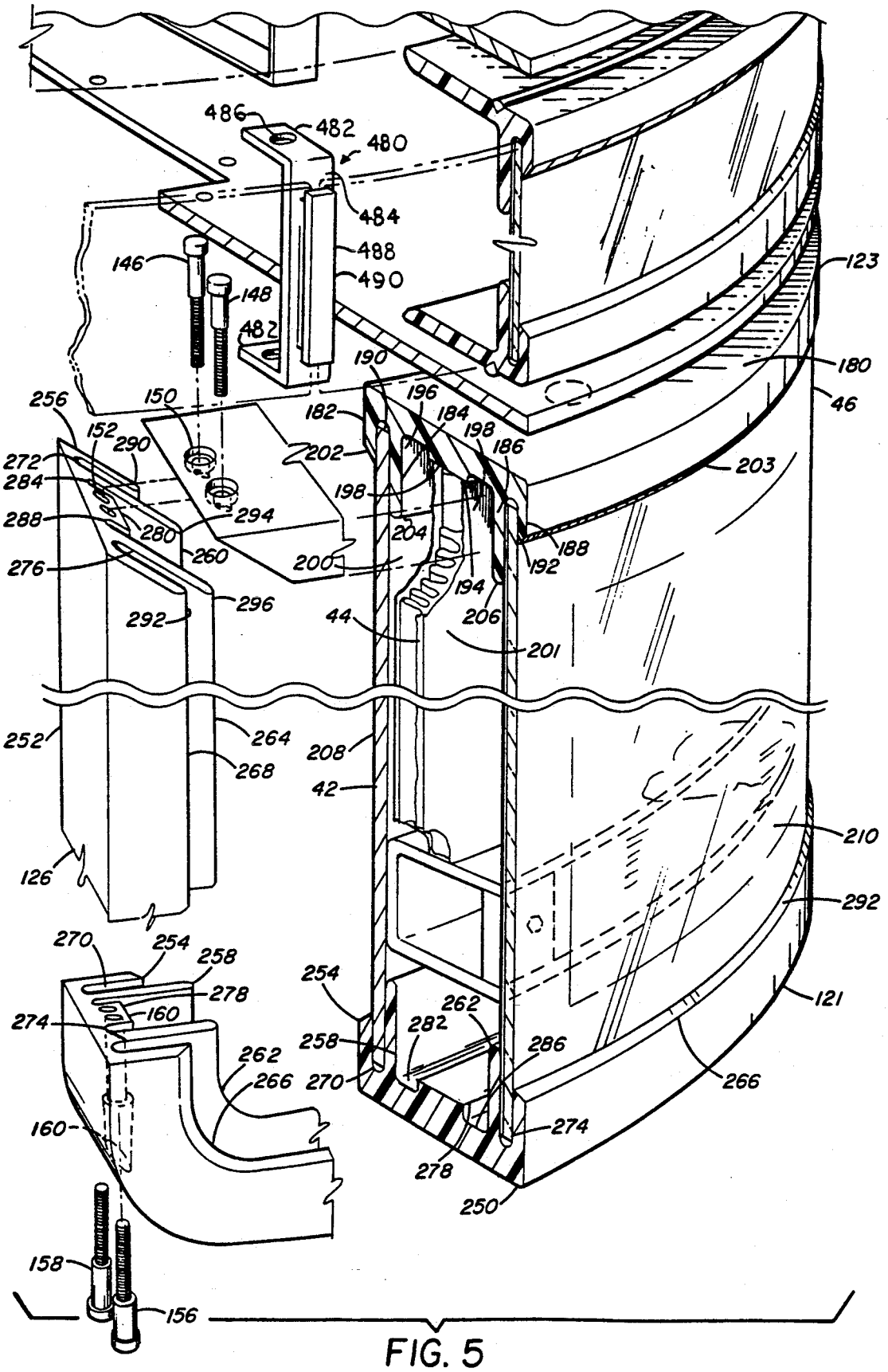
FIG. 5 shows a partially exploded, fragmented, perspective view of the telephone enclosure.

The first panel assembly 20 includes a perforated inner panel 34 (shown in FIG. 3), a middle insulation panel (not shown) and an outer panel 38, which are all arcuate shaped. A body rail assembly 40 receives the inner panel 34, the insulation panel and the outer panel 38. Likewise, as shown in FIGS. 4 and 5, the second panel assembly 22 includes a perforated inner panel 42, a middle insulation panel 44 and an outer panel 46, which are all arcuate shaped. A body rail assembly 48 receives the inner panel 42, the insulation panel 44 and the outer panel 46. Preferably, the inner panels 34, 42 are made of perforated metal, such as stainless steel or aluminum, the insulation panels are made of fiberglass or other acoustic insulating material, such as a foam material, and the outer panels 38, 46 are made of metal.

Figure 3:
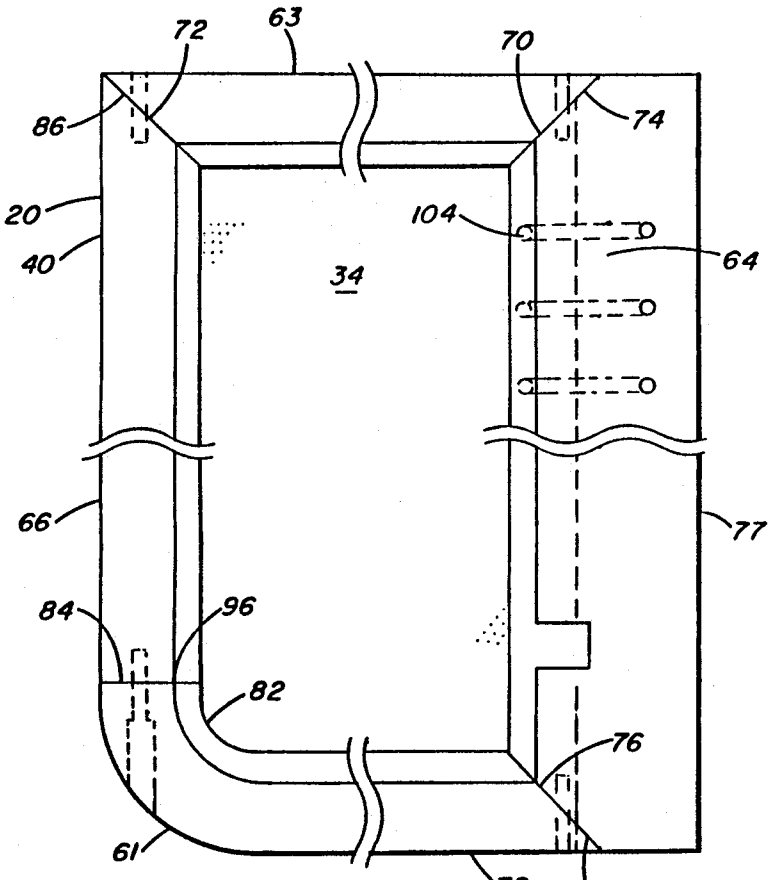
FIG. 3 shows a side view of a first panel assembly of the telephone enclosure.
Figure 6:
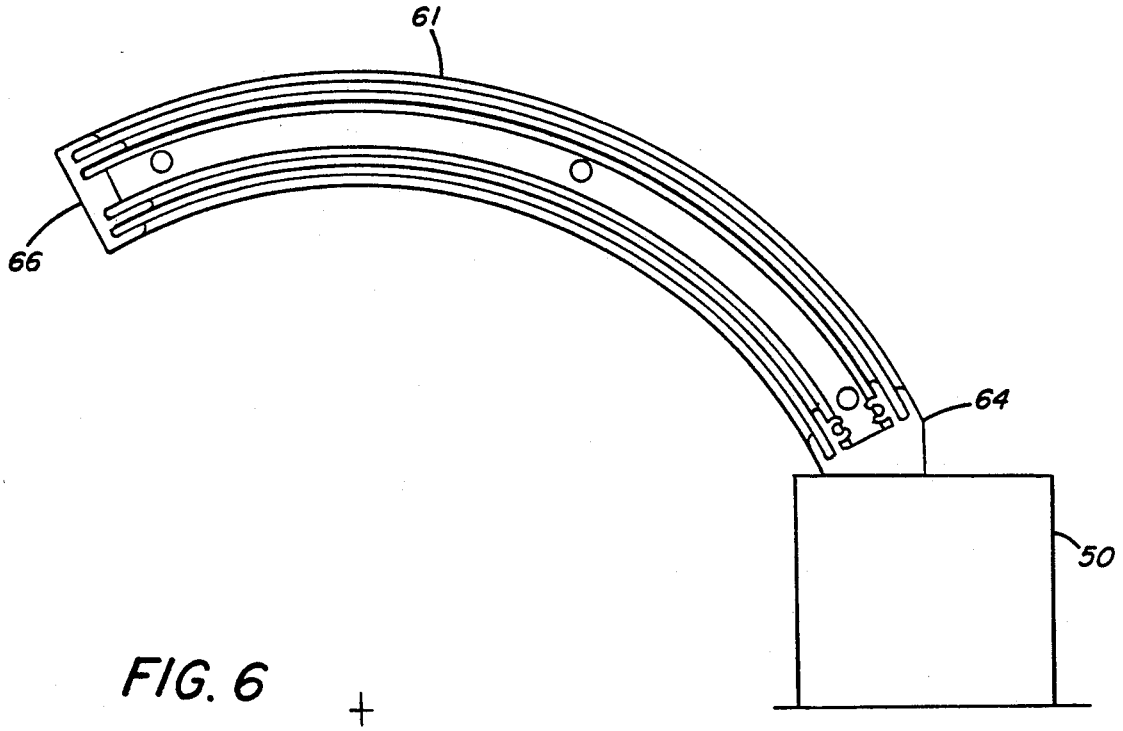
FIG. 6 shows a top view of a portion of the rail assembly.
Figure 7:
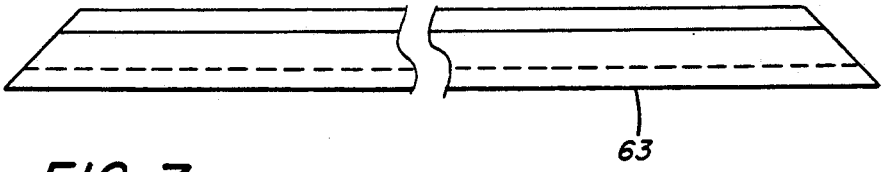
FIG. 7 shows a side view of a second rail of the rail assembly.

Referring to FIGS. 3, 6 and 7, the body rail assembly 40 includes a substantially L-shaped bottom rail or first rail 61, a straight top rail or second rail 63, a straight first side rail or third rail 64, and a straight second side rail or fourth rail 66. Specifically, the top rail 63 has a mitred first end 70 and a mitred second end 72. The first side rail 64 has a mitred first end 74 attached to the first end 70 of the top rail 63 by threaded fasteners and a mitred second end 76. The first side rail 64 also has section 77 triangular with a cross-section. The L-shaped bottom rail 61 has straight first section 78 with a mitred first end 80 and a depending second section 82 having a flat second end 84. A radiused section is positioned at the junction between the first end 80 and the second end 84. The first end 80 of the bottom rail 61 is attached to the second end 76 of the first side rail by threaded fasteners. The second side rail 76 includes a mitred first end 86 fastened to the second end 72 of the top rail 60 by threaded fasteners. The second side rail 66 also includes a flat second end 96 attached to the second end 84 of the bottom rail 61 by threaded fasteners. The first panel assembly 20 is threadably fastened to the back panel 50 by fasteners 104.

Figure 8:
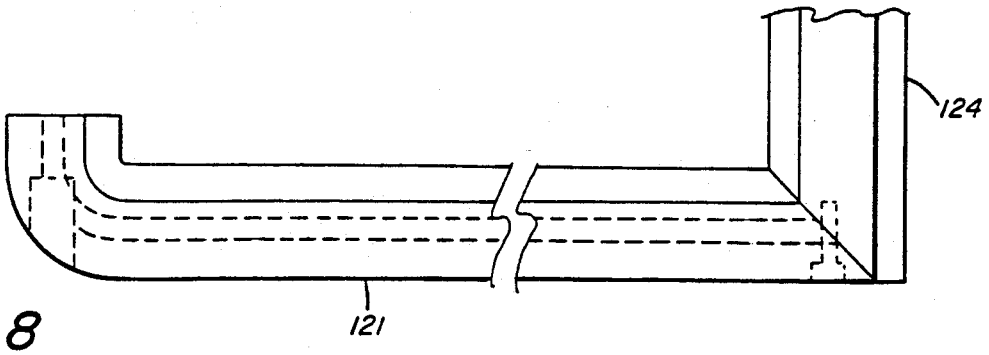
FIG. 8 shows a side view of the rail assembly shown in FIG. 2.

FIGS. 4, 5 and 8 show the body rail assembly 48 of the second panel assembly 22. The body rail assembly 48 includes a substantially L-shaped bottom rail or first rail 121, a straight top rail or second rail 123, a straight first side rail or third rail 124, and a straight second side rail or fourth rail 126. The top rail 123 has a mitred first end 128 and a mitred second end 130. The first side rail 124 has a mitred first end 132 attached to the first end 128 of the top rail 123 by threaded fasteners, and a mitred second end 134. The first side rail 124 also has a section 135 with a triangular cross-section. The L-shaped bottom rail 121 has straight first section 136 with a mitred first end 138 and a depending second section 140 having a flat second end 142. A radiused section is positioned at the junction between the first end 138 and the second end 142. The first end 138 of the bottom rail 121 is attached to the second end 134 of the first side rail 124 by threaded fasteners. The second side rail 126 includes a mitred first end 144 fastened to the second end 130 of the top rail 123 by threaded fasteners 146 and 148 which pass through bores 150 located in the top rail 123 and bores 152 located in the second side rail 126. The second side rail 126 also includes a second flat end 154 attached to the second end 142 of the bottom rail 121 by threaded fasteners 156 and 158 which pass through bores 160 located in the bottom rail 121 and respective bores located in the second side rail. The second panel assembly 22 is threadably fastened to the back panel 50 by fasteners 162. Further, respective mitered ends for both panel assemblies 20, 22 are complementary to each other, as are the respective flat ends.

As is evident from FIGS. 3 and 4, the first panel assembly 20 is a mirror image of second panel assembly 22. Accordingly, only the second panel assembly 22 will be discussed in detail. FIG. 5 shows the actual configuration of the rails 121, 123 and 126 maintaining the inner panel 42, insulation panel 44 and outer panel 46 in spaced relation to each other. Specifically, the top rail 123 includes a base 180 with an integral first leg 182, an integral second leg 184, an integral third leg 186 and an integral fourth leg 188 all depending in a first direction therefrom. The first leg 182 is positioned in spaced relation to the second leg 184 defining an inner panel receiving slot 190 therebetween. The third leg 186 is positioned in spaced relation to the fourth leg 188 defining an outer panel receiving slot 192. The inner panel 42 is slideably received by said inner panel receiving slot 190 and the outer panel 46 is slideably received by the outer panel receiving slot 192. The top rail also includes an integral insulation receiving step 194 which also depends from the base 180. The step 194 is positioned between the second leg 184 and the third leg 186. A first recess 196 is defined between the second leg 184 and the step 194 and a second recess 198 is defined between the step 194 and the third leg 186. A first edge 198 of the insulation panel 44 abuts against the step 194. A first air gap 200 is defined between the inner panel 42 and the insulation panel 44 and a second air gap 201 is defined between the insulation panel 44 and the outer panel 46. The air gaps 200, 201 improve the sound insulation of the enclosure 10.

Preferably, the first leg 182 and the fourth leg 188 have a first height and the second leg 184 and the third leg 186 have a second height where the second height is greater than the first height. Further, it is preferable that the first leg 182, the second leg 184, the third leg 186 and the fourth leg 188 are substantially parallel to each other. Furthermore, it is preferable that the first leg 182 and the fourth leg 188 have beveled tips 202 and 203, and the second leg 184 and third leg 188 have rounded tips 204 and 206. The beveled tip 202 abuts against an inner surface 208 of the inner panel 42, and the beveled tip 203 abuts against an outer surface 210 of the outer panel 46.

The bottom rail 121 and first side rail 126 have a similar leg arrangement as that of the top rail 123. The bottom rail 121 and second side rail 126 include bases 250, 252 with integral first legs 254, 256, integral second legs 258, 260, integral third legs 262, 264 and integral fourth legs 266, 268 depending therefrom, respectively. The first legs 254, 256 are positioned in spaced relation to the second legs 258, 260 defining inner panel receiving slots 270, 272 therebetween, respectively. The third legs 262, 264 are positioned in spaced relation to the fourth legs 266, 268 and define outer panel receiving slots 274, 276, respectively. The first legs 254, 256 and the fourth legs 266, 268 have a length equal to the first height, and the second legs 258, 260 and the third legs 262, 264 have a length equal to the second height. Further, first legs 254, 256, second legs 258, 260, third legs 262, 264 and fourth legs 266, 268 are substantially parallel to each other, respectively. Integral steps 278, 280 depend from the bases 250, 252, respectively. The steps 278, 280 are positioned between the second legs 258, 260 and the third legs 262, 264, respectively. First recesses 282, 284 are defined between the second legs 258, 260 and the steps 278, 280 and second recesses 286, 288 are defined between the steps 278, 280 and the third legs 262, 264, respectively. Furthermore, it is preferable that the first legs 254, 256 have beveled tips 290 and the fourth legs 266, 268 have beveled tips 292. Preferably, the second legs 258, 260 have rounded tips 294 and third legs 262, 264 have rounded tips 296. The beveled tips 290 abut against the inner surface 208 of the inner panel 42, and the beveled tips 292 abut against the outer surface 210 of the outer panel 46.

As shown in FIG. 4, the first side rail 124 also has a similar leg arrangement as the second side rail 126. The first side rail has a base 300 with an integral first leg 302, an integral second leg 304, an integral third leg 306 and an integral fourth leg 308 depending therefrom. The first leg 302 is positioned in spaced relation to said second leg 304 and defines an inner panel receiving slot 310 therebetween. The third leg 306 is positioned in spaced relation to said fourth leg 308 and defines an outer panel receiving slot 312. The first leg 302 and fourth leg 308 have beveled tips and the second leg 304 and the third leg have rounded tips. All of the legs are substantially parallel to each other.

The first side rail 124 also has a screw port 314 defined by the second leg 304 and the third leg 306. The screw port 314 includes a first member 316 having an arcuate shape or C-shape facing a second member 318 having an arcuate shape or C-shape. The first member 316 is integral with the base 300 and the second leg 304, and the second member 318 is integral with the base 300 and third leg 306. A panel edge receiving recess 320 is defined between the first member 316 and the second member 318. The spacing between the members 316, 318 is less than the thickness of the insulation panel 44, so that insulation panel 44 is sandwiched between the members 316, 318 and frictionally held in place. The screw port 314 receives a fastening screw passing through rail 123 and connecting rail 123 to rail 124.

The above-described rails used for the body rail assemblies 40, 48 may be made of a plastic material or aluminum. These materials afford light weight and durability to the rails which are subject to the outdoor environment. Further, these materials may easily be extruded or molded in the shapes of the rails.

As stated previously, the first panel 20 and the second panel 22 mount to the back panel assembly 50 by threaded fasteners passing through the second side rails 66, 126, respectively. The back panel 50 extends approximately one-half of the side rails 64, 124. As shown in FIGS. 9 and 13–18, the back panel 50 includes a frame 344 that is bolted to a top side of the support post 16, and a perforated center panel 346 threadably attached to an inner portion of the frame 344 as well as positioned between the ceiling assembly 12 and the support post 16. A ceiling center frame 342 abuts against a rearward section of the ceiling assembly 12. A lower end of the ceiling center frame 342 attaches to an upper end of frame 344.

The ceiling center frame 342 has four depending lips 348, 350, 352 and 354 along its perimeter. Lips 350 and 354 have a plurality of holes to receive fasteners. Frame 344 has four depending lips 356, 358, 360 and 362, which have a plurality of holes to receive fasteners. Lip 358 attaches to post 16 and lip 362 attaches to lip 354 of frame 342. Appropriate fasteners fasten frame 342 to frame 346 by passing through respective fastening holes. Likewise, appropriate fasteners pass through lips 356, 360 attaching respective panels 20, 22 thereto. Panel 346, which is optional, also has four depending lips 364, 366, 368 and 370. Two tabs 372 with fastener receiving holes are integral with and extend from lips 366 and 370, respectively. Panel 346 is received between the lips of frame 344 where lips 356, 358, 360, and 362 are positioned adjacent to lips 364, 366, 368 and 370. Appropriate fasteners pass through the tab holes and corresponding holes in frame 344 and fasten panel 346 thereto. Preferably, panel 346 is metal, such as stainless steel.

Referring to FIGS. 1, 5, 10, 11 and 19, the shelf assembly 24 includes a shelf 331 welded to a shelf brace 332. An underside of the shelf 331 rests on the brace 332 which adds structural support to the shelf assembly 24. Shelf 331 attaches to the support post 16 and panel assemblies 20, 22. Fasteners pass through a rear leg 334 of the shelf 331 attaching it to the supporting post 16.

Figure 14:
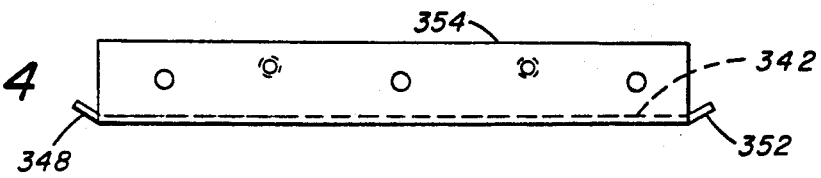
FIG. 14 shows another side view of the panel shown in FIG. 12.
Figure 15:
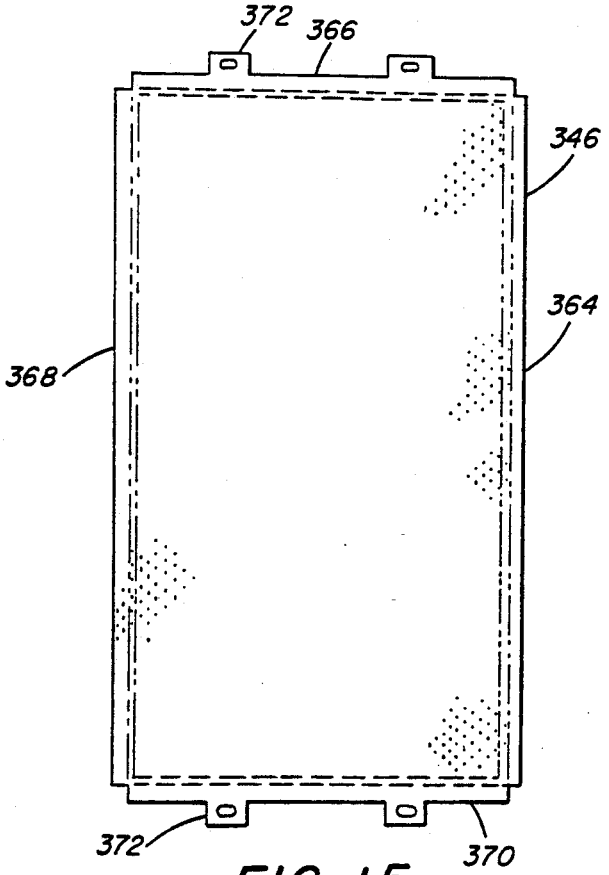
FIG. 15 shows a perforated center inner panel.
Figure 16:
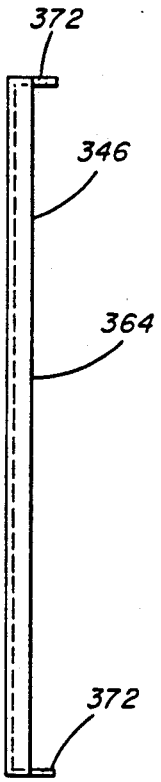
FIG. 16 shows a side view of the panel shown in FIG. 15.
Figure 17:
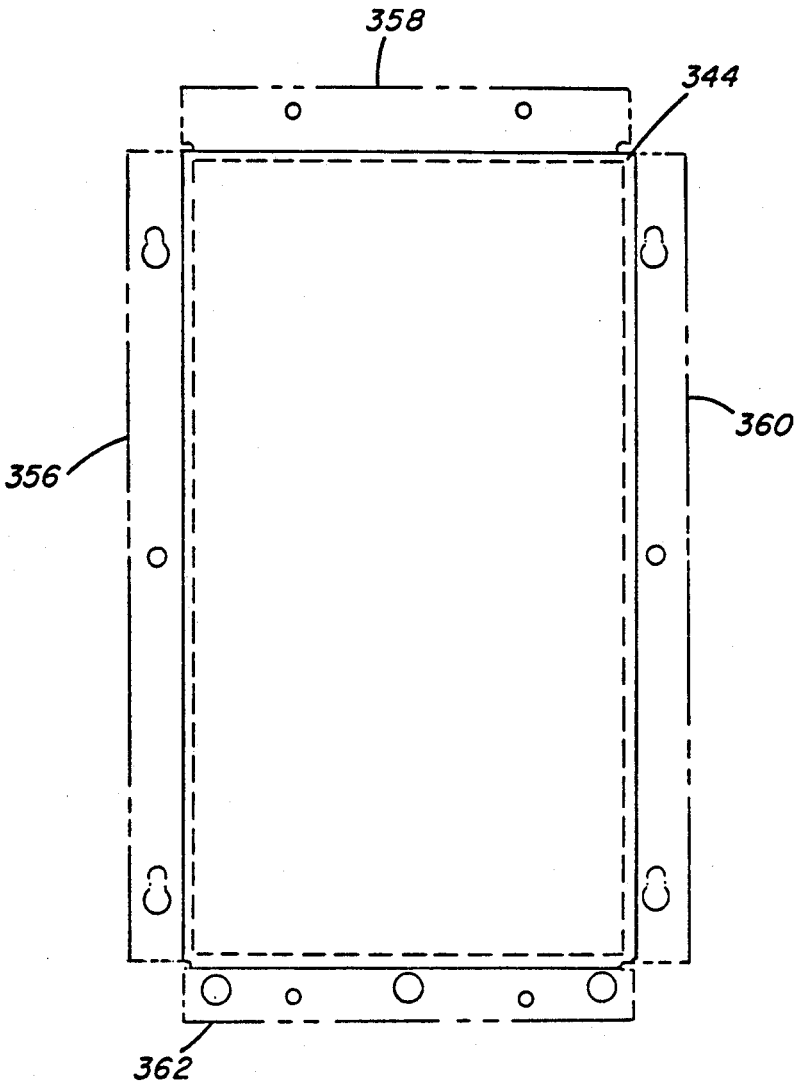
FIG. 17 shows a front view of a center middle panel.
Figure 18:
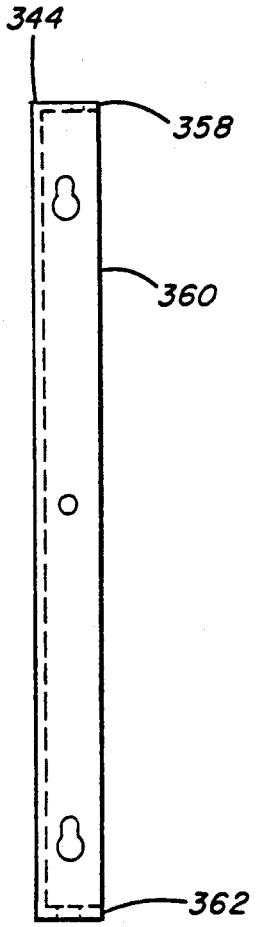
FIG. 18 shows a side view of the panel of FIG. 17.
Figure 19:
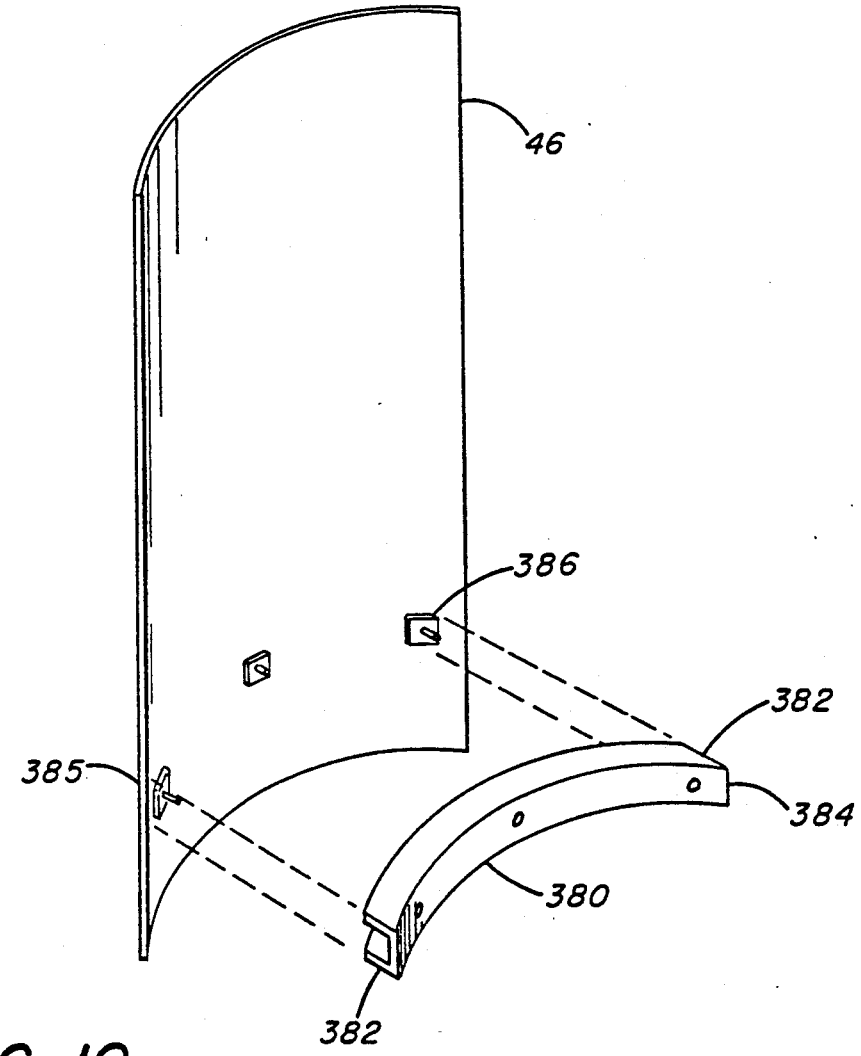
FIG. 19 shows a partially exploded-fragment perspective view of a shelf channel and an outer panel.
Figure 20:
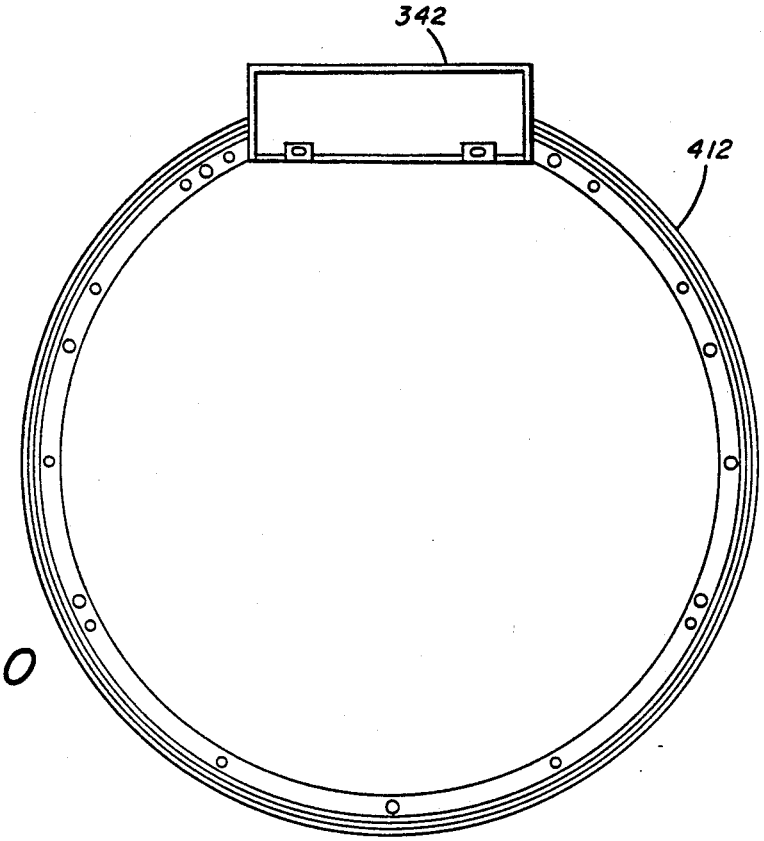
FIG. 20 shows a top view of a first ceiling bottom rail and a back panel of the telephone enclosure.

Mounting hardware 26, 28, 30 and 32 are welded to respective sides of the shelf 331. Fasteners pass through mounting hardware and into a respective shelf supporting channel 380 located in each panel assembly 20, 22. Each channel 380 is a curved channel having a C-shaped cross section conforming to the curvature of panels. FIGS. 5 and 14 show the channel 380 in panel assembly 22. The channel 380 has two legs 382 and a base 384. As shown in FIG. 19, the legs 382 abut against the outer panel 46. Three square blocks 386 are welded to a lower inner section 385 and outer panel 46. The edge length of the blocks 386 approximately equals the spacing between the legs 382. The blocks 386 are received by the between legs 382 of channel 380, and welded thereto.

The base 384 of channel 380 abuts against the inner panel 42. The fasteners passing through mounting hardware 30, 32 also pass through holes located in the base 384 of the channel 380, thereby mounting the shelf 24 to the panel assembly 22. As is evident, a lower edge of the insulation panel abuts an upper leg 386 of channel 380.

Figure 9:
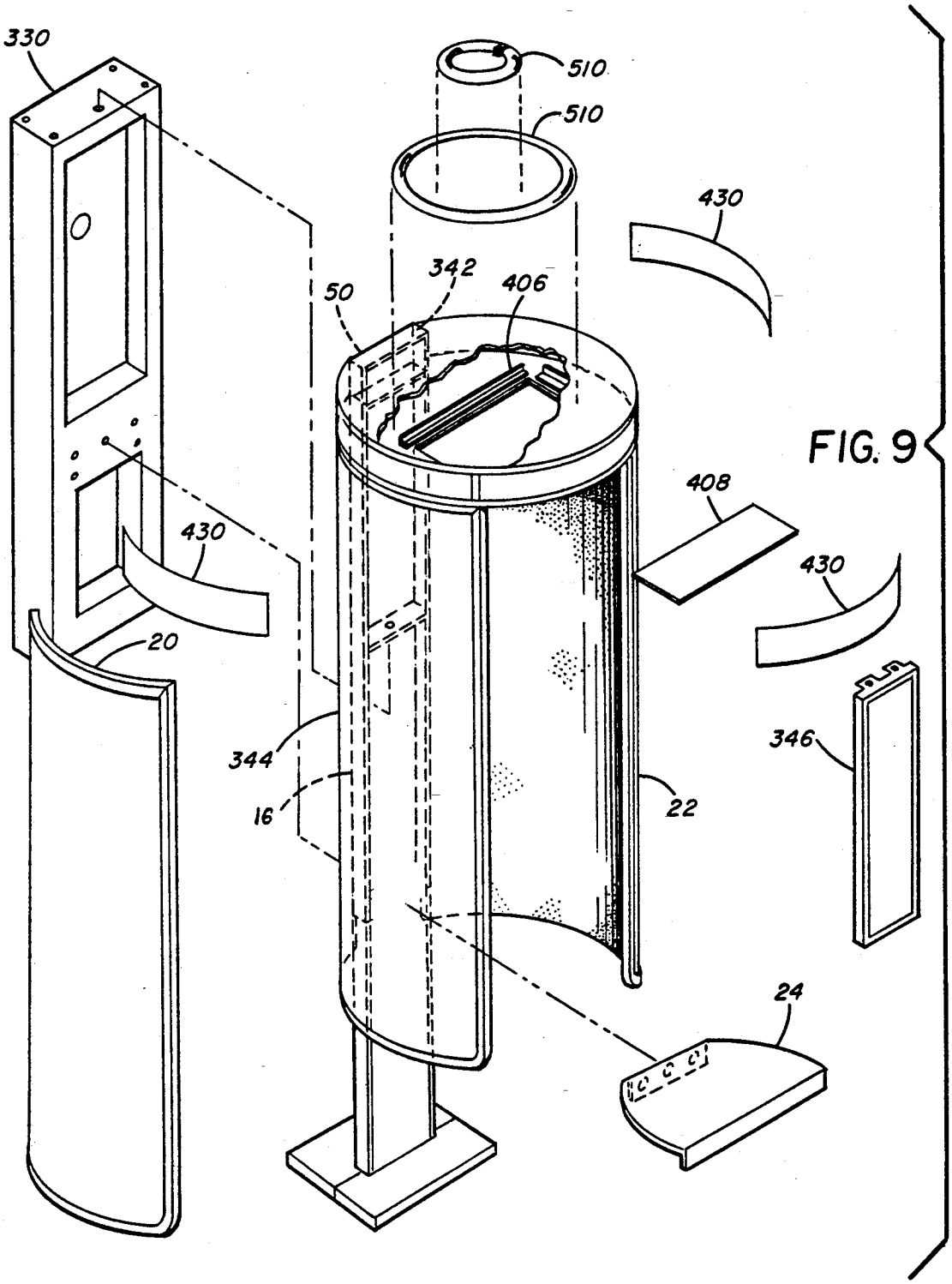
FIG. 9 shows an exploded, fragmented, perspective view of the body and ceiling assembly of the telephone enclosure.
Figure 10:
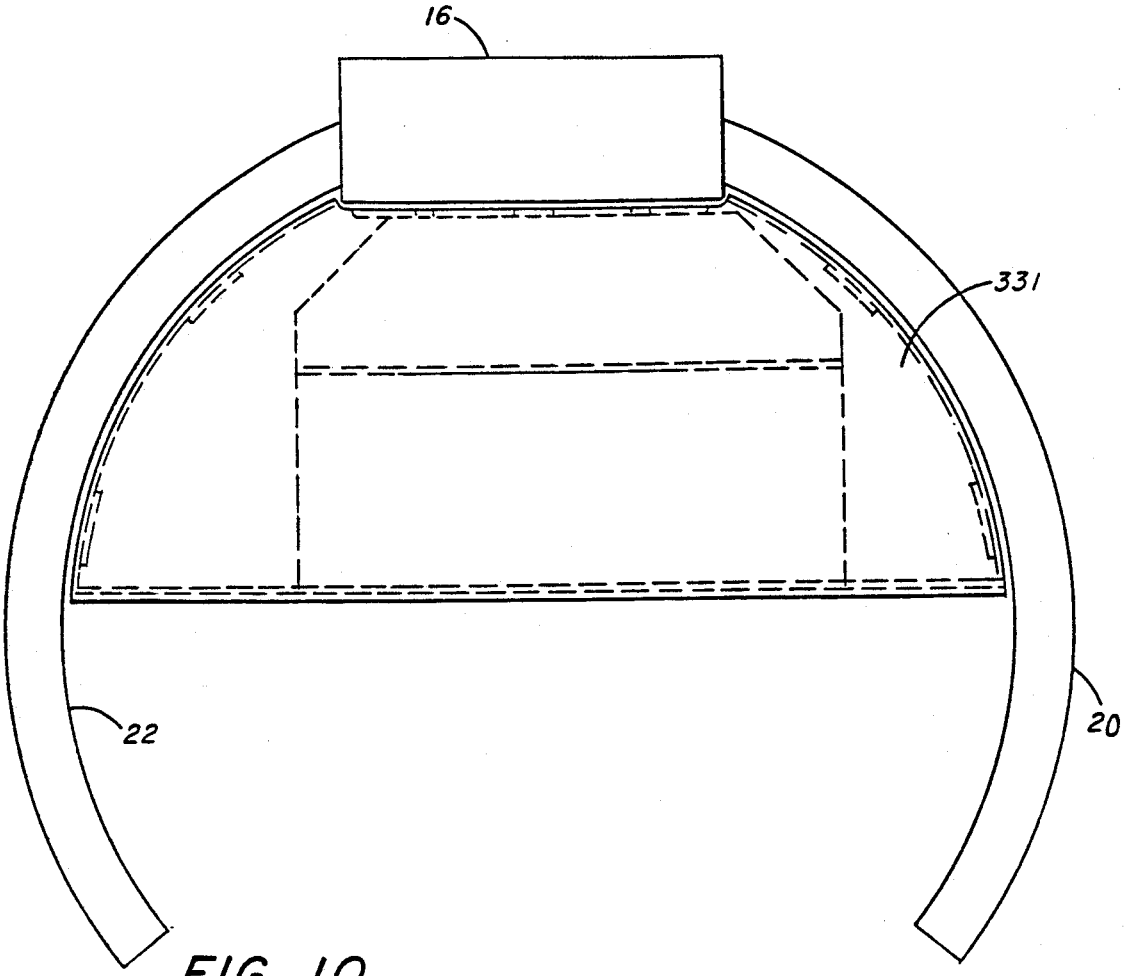
FIG. 10 shows a top view of the shelf assembly of the telephone enclosure.
Figure 11:
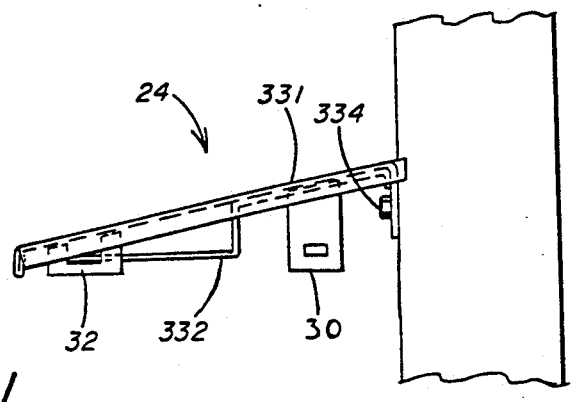
FIG. 11 shows a side view of a shelf assembly of the telephone enclosure.
Figure 12:
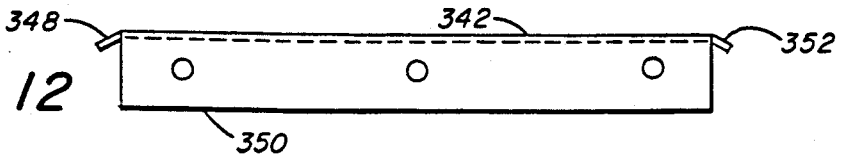
FIG. 12 shows a side view of center back panel of the telephone enclosure.
Figure 13:
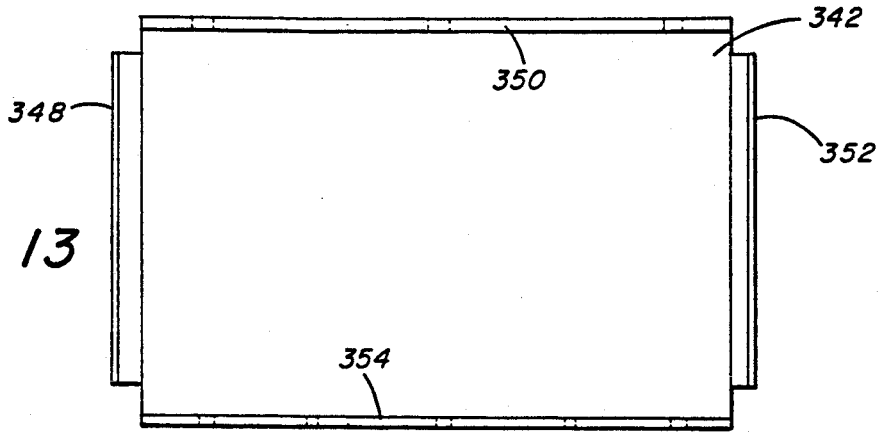
FIG. 13 shows a front view of the panel shown in FIG. 12.
Figure 21:
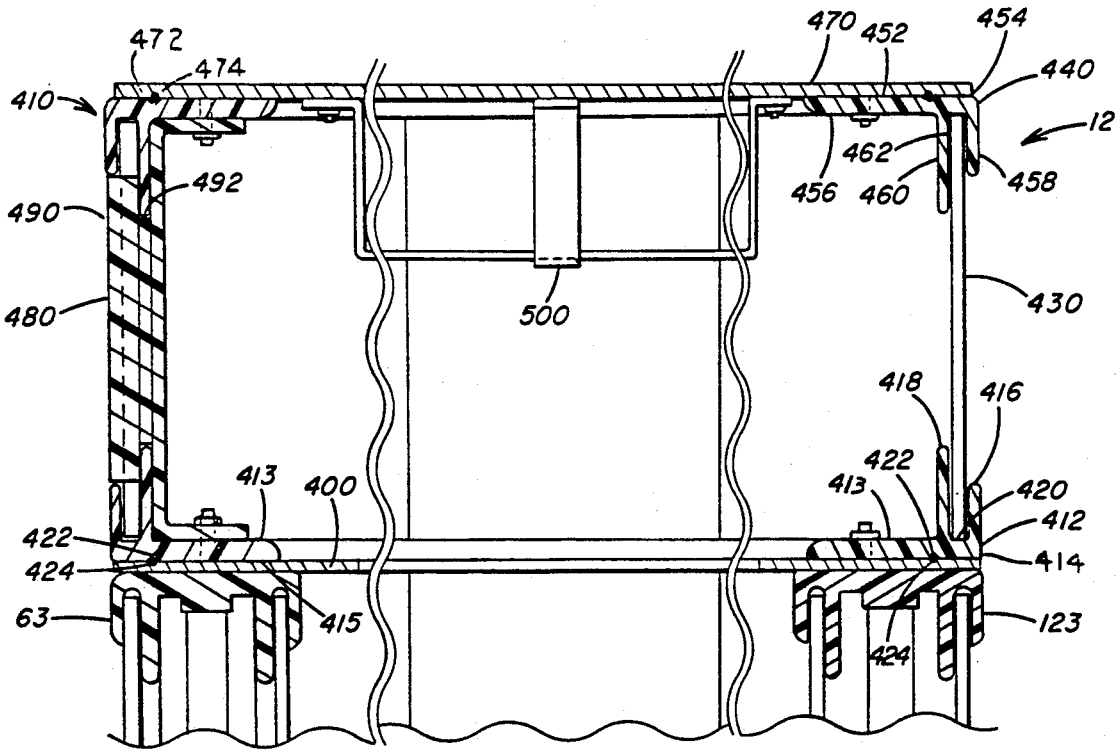
FIG. 21 shows a partial cross-sectional view of the telephone enclosure ceiling mounted to the telephone enclosure body.
Figure 22:
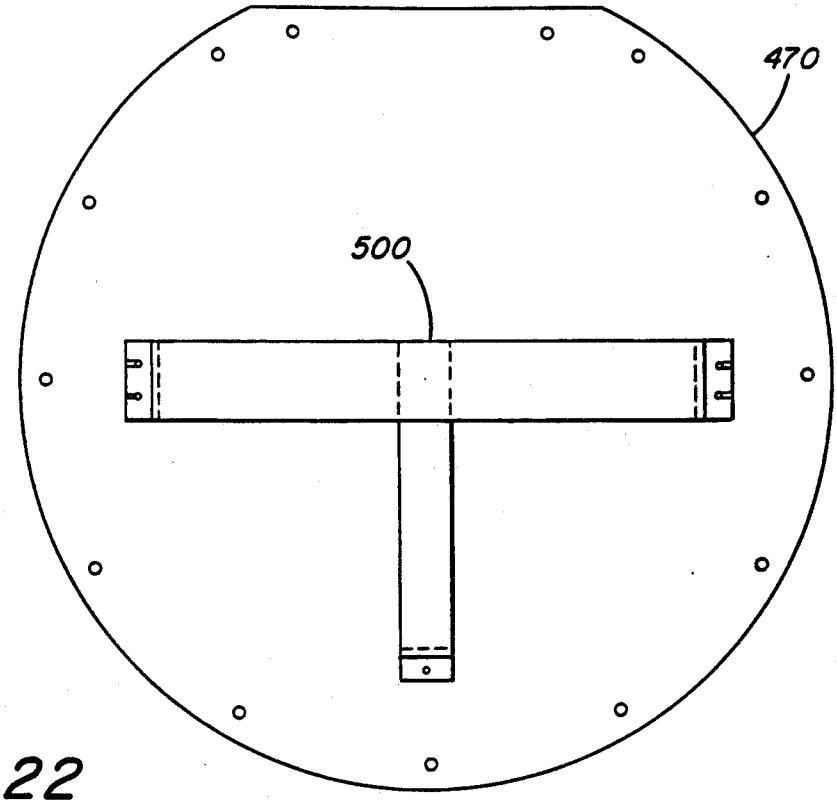
FIG. 22 shows a ceiling top plate.
Figure 23:
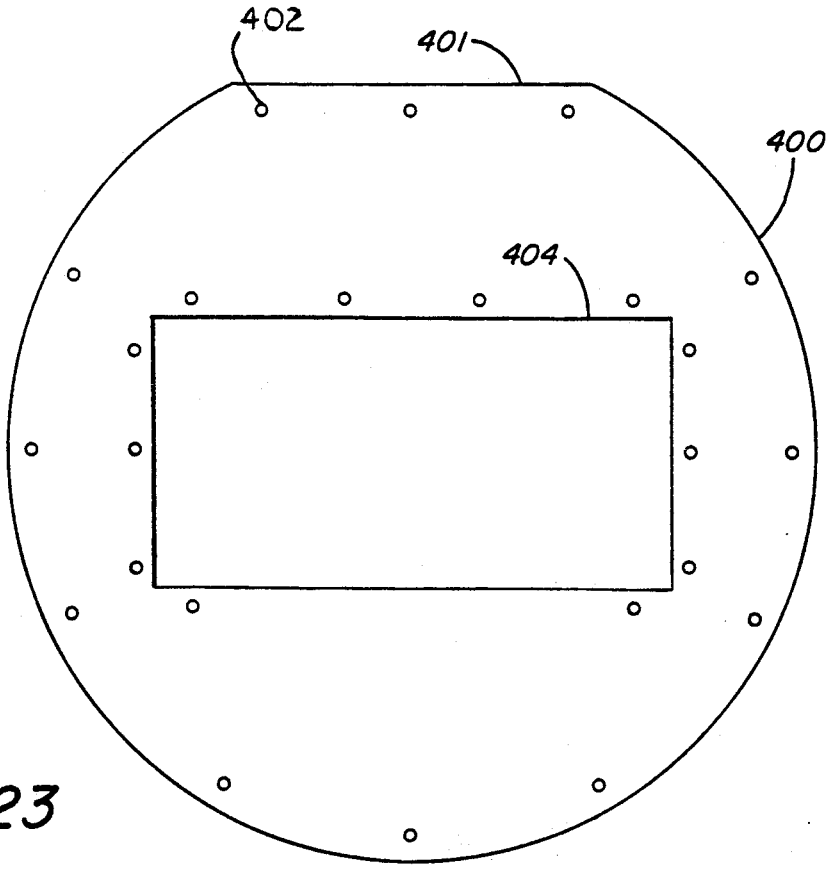
FIG. 23 shows a ceiling bottom plate.

As shown in FIGS. 1, 9 and 20–23, the ceiling assembly 12 is substantially cylindrical in shape and abuts against a portion of the ceiling center frame 342. The ceiling assembly 12 includes a substantially circular ceiling bottom plate 400, as shown in FIG. 22, which is made up of an arc of a circle extending approximately 270 degrees and a straight section 401. The radius of the circular portion of the bottom plate is approximately the same as the outer radius of the outer panels 38, 46. The ceiling assembly 12 mounts to the top rails 63, 123 by fasteners passing through fastener receiving holes 402 into corresponding holes located in the top rails 63, 123. The straight section 401 of the ceiling plate 400 abuts the ceiling center frame 342. The ceiling bottom plate 400 also includes a rectangular cutout 404. Supports 406 mount about the perimeter of the cutout and receive a translucent cover plate 408 therebetween, as shown in FIG. 9.

A signage assembly 410 also attaches to the ceiling bottom plate 400. The signage assembly 410 includes an arcuate shaped first ceiling rail 412 having a base 413 with a first section 414 and a second section 415. The first section 414 of the base 413 includes an integral outer first leg 416 and an integral inner second leg 418, both depending from the base 413. A first ceiling panel receiving slot 420 is defined between the first leg 416 and the second leg 418. The first leg 416 is shorter than the second leg 418 and the legs 416, 418 are substantially parallel to each other. A plurality of fastener receiving holes are spaced about the second section 415 of the base 413 which receive weld studs. The weld studs receive appropriate fasteners for attaching the bottom rail 412 to the ceiling bottom plate 400. A V-shaped groove 422 is provided on a surface of the base 413 opposite the legs 416, 418. A seal, such as a caulking material 424, is received by the groove 422 and sandwiched between the base 413 and the first ceiling plate 400. Optionally, caulking material 424 may be replaced by a gasket. A bottom edge of a translucent signage panel 430 is slideably received by the slot 420.

The signage assembly 410 also includes an arcuate shaped second ceiling rail 440 which receives a top edge of the signage panel 430. The second ceiling rail 440, which is similar to the bottom rail 412, is positioned across from the first ceiling rail 412. The ceiling rail 440 includes a base 452 having a first section 454 and a second section 456. The first section 454 of the base 452 includes an integral outer first leg 458 and an integral inner second leg 460, both depending from the base 452 toward the first ceiling rail 412. A second ceiling panel receiving slot 462 is defined between the first leg 458 and the second leg 460. The first leg 458 is shorter than the second leg 460 and the legs 458, 460 are substantially parallel to each other. A top edge of the signage panel 430 is slideably received by the ceiling panel receiving slot 462. A plurality of fastener receiving holes are spaced about the second section 456 of the base 452 and receive weld studs. The weld studs receive appropriate hardware for attaching the second ceiling rail 440 to a ceiling top plate 470. The ceiling top plate 470 is of the similar shape as the ceiling bottom plate 400 except it does not have the cutout 404. A V-shaped groove 472 is provided on a surface of the base 452 opposite the legs 458, 460. A seal 474, such as caulking material, is received by the groove 472 and is sandwiched between the base 452 and the ceiling top plate 470 forming a compartment between the bottom plate 400 and the top plate 470.

The first ceiling rail 412 attaches to the second ceiling rail 440 by a diffuser separator 480, see FIGS. 5 and 21. The diffuser separator is C-shaped having two end segments 482 depending from a middle segment 484 that abuts an end of panel 430. Each end segment 482 has a fastener receiving hole 486 through which a weld stud passes. The weld studs receive fasteners passing through the first ceiling rail 412 and second ceiling rail, respectively. The middle segment 484 includes an integral stepped plate 488. The stepped plate 488 includes a first rectangular segment 490 received between first ceiling rail leg 416 and second ceiling rail leg 458 and a second rectangular segment 492 received between first ceiling rail leg 418 and second ceiling rail leg 460. The panel 430 abuts against first rectangular segment 490, which prevents movement of the pane 430. The length and the width of the first segment 490 are greater than the length and width of the second segment 492. One or more diffuser separators 480 may be used in the present invention. This enables the use of several signage panels 430 in the signage assembly 410. In the present case, three signage panels 430 are used.

As shown in FIGS. 21 and 22, a lighting bracket 500 mounts to an inner surface of the top plate 470. The bracket receives a lighting fixture that includes two fluorescent bulbs 510, as shown in FIG. 9. Sufficient hardware and electric lines are provided to energize the bulbs 510. Although this hardware is not shown it is well known in the art. When the bulbs 510 are energized, the phone booth enclosure as well as the signage panel 430 are illuminated.

Most of the elements of the telephone enclosure, with the exception of electrical components, may be made of thin gauge stainless steel or aluminum, or plastic. This affords a lightweight enclosure, on the order of 80 pounds. Thus, the enclosure can be assembled and repaired by one individual. Further, the panel assemblies 20, 22 can easily be replaced if damaged, and repair can easily be made at a repair shop. The lightweight panel assemblies also aid in allowing one person to replace them. Likewise, the signage panel 430 may be easily replaced by removing the ceiling top plate 470, the second ceiling rail 440 and the diffuser separator 480; replacing the panel within the slot 420 of the first ceiling panel 412; and then replacing the removed elements. Furthermore, as can be seen, the parts of the enclosure 10 can be easily and cheaply manufactured. This results in an inexpensive telephone enclosure 10.

Having described the presently preferred embodiment of the invention, it is to be understood that it may be otherwise embodied within the scope of the appended claims.

We claim:

1. A phone enclosure comprising:

an acoustic housing having an outer panel;

an inner panel;

an acoustic insulation panel; and a body rail assembly, said body rail assembly comprising a first rail having a first rail base with an integral first leg, an integral second leg, an integral third leg and an integral fourth leg depending therefrom, said first leg positioned in spaced relation to said second leg and defining a first rail inner panel receiving slot therebetween, said third leg positioned in spaced relation to said fourth leg and defining a first rail outer panel receiving slot, said inner panel slideably received by said first rail inner panel receiving slot and said outer panel slideably received by said outer panel receiving slot, said first rail also having a first rail insulation receiving step integral to and depending from said first rail base, said step positioned between said second leg and said third leg wherein a first recess is defined between said second leg and said first rail step and a second recess is defined between said first rail step and said third leg wherein a first edge of said insulation panel abuts against said step and a first air gap is defined between said inner panel and said insulation panel and a second air gap is defined between said insulation panel and said outer panel.

2. The phone booth of claim 1 wherein said body rail assembly further includes:

a second rail having a second rail base with an integral fifth leg, an integral sixth leg, an integral seventh leg and an integral eighth leg depending toward said first rail, said fifth leg positioned in spaced relation to said sixth leg and defining a second rail inner panel receiving slot therebetween, said seventh leg positioned in spaced relation to said eighth leg and defining a top rail outer panel receiving slot, said inner panel slideably received by said top rail inner panel receiving slot and said outer panel slideably received by said top rail outer panel receiving slot; said first rail inner panel receiving slot positioned across from said second rail inner panel receiving slot, and said first rail outer panel receiving slot positioned across from said second rail outer panel receiving slot, said bottom rail further comprising a second rail step integral to and depending from said base, said second rail step positioned between said sixth leg and said seventh leg wherein a third recess is defined between said sixth leg and said step and a fourth recess is defined between said step and said seventh leg, said first rail step positioned across from said top rail step.

3. The phone booth of claim 2 wherein said rail assembly further includes:

a third rail having a first side rail base with an integral ninth leg, an integral tenth leg, an integral eleventh leg and an integral twelfth leg depending therefrom, said ninth leg positioned in spaced relation to said tenth leg and defining a third rail inner panel receiving slot therebetween, said eleventh leg positioned in spaced relation to said twelfth leg and defining a third rail outer panel receiving slot, said inner panel slideably received by said third rail inner panel receiving slot and said outer panel slideably received by said third rail outer panel receiving slot, a first end of said third rail attaches to a first end of said second rail and a second end of said third rail attaches to a first end of said first rail; and a screw port defined by said tenth leg and said twelfth leg.

4. The phone booth of claim 3 wherein said rail assembly further includes:

a fourth rail having a fourth rail base with an integral thirteenth leg, an integral fourteenth leg, an integral fifteenth leg and an integral sixteenth leg depending therefrom, said thirteenth leg positioned in spaced relation to said fourteenth leg and defining a fourth rail inner panel receiving slot therebetween, said fifteenth leg positioned in spaced relation to said sixteenth leg and defining a second side rail outer panel receiving slot, said inner panel slideably received by said fourth rail inner panel receiving slot and said outer panel slideably received by said fourth rail outer panel receiving slot, said fourth rail further comprising a fourth rail step integral to and depending from said fourth rail base, said fourth rail step positioned between said fourteenth leg and said fifteenth leg wherein a fifth recess is defined between said fourteenth leg and said second side rail step and a sixth recess is defined between said fourth rail step and said fifteenth leg, a third edge of said insulation panel abuts against said fourth rail step, said fourth rail having a first end and a second end where said first end of said fourth rail attaches to a second end of said top rail and said second end of said fourth rail attaches to a second end of said first rail.

5. The phone enclosure of claim 1 wherein said first leg and said fourth leg have a first height and said second leg and said third leg have a second height and said second height is greater than said first height, said first leg, said second leg, said third leg and said fourth leg are substantially parallel to each other.

6. The phone enclosure of claim 5 wherein said first leg and said fourth leg have beveled tips and said second leg and said third leg have rounded tips.

7. The phone enclosure of claim 4 wherein said first leg, said fourth leg, said fifth leg, said eighth leg, said ninth leg, said twelfth leg, said thirteenth leg and said sixteenth leg have a first height and the remainder of said legs have a second height, where said second height is greater than said first height.

8. The phone enclosure of claim 7 wherein said first leg, said fourth leg, said fifth leg, said eighth leg, said ninth leg, said twelfth leg, said thirteenth leg and said sixteenth leg have beveled tips and the remainder of the legs have rounded tips.

9. The phone enclosure of claim 1 wherein said insulation panel is made of fiberglass and said inner panel has a plurality of perforations.

10. The phone enclosure of claim 3 wherein said screw ports comprise a first arcuate shaped member integral with said tenth leg and a second arcuate shaped member integral with said eleventh leg, said first member facing said second member and said first member and said second member defining an insulation panel edge receiving recess which receives a fourth edge of said insulation panel.

11. The phone enclosure of claim 10 wherein said first member and said second member are C shape.

12. The phone enclosure of claim 4 further comprising a ceiling assembly having a first ceiling rail and a second ceiling rail, said first ceiling rail having a first ceiling rail base, an integral seventeenth leg and a spaced integral eighteenth leg depending therefrom, said seventeenth leg and eighteenth leg defining a first ceiling panel receiving slot therebetween, said second ceiling rail positioned across from said first ceiling rail and includes a second ceiling rail base, an integral nineteenth leg and a spaced integral twentieth leg depending therefrom, said nineteenth leg and said twentieth leg defining a second ceiling panel receiving slot; and a removable translucent roof panel having a first edge slideably received by said first ceiling panel receiving slot and a second edge slideably received by said second ceiling panel receiving slot.

13. The phone enclosure of claim 12 wherein said roof assembly further comprises:

a top plate attached to said second ceiling rail;

a bottom plate attached to said first ceiling rail; and a first sealing ring sandwiched between said top plate and said first ceiling rail and a second sealing ring sandwiched between said bottom plate and said first ceiling rail.

14. The phone enclosure of claim 13 wherein a first surface of said first ceiling rail has a first groove which receives said first sealing ring, and a first surface of said second ceiling rail has a second groove which receives said second sealing ring.

15. The phone enclosure of claim 13 wherein said first sealing ring and said second sealing ring are made of caulking material.

16. The phone enclosure of claim 15 wherein said ceiling assembly further comprises by a light source.

17. The phone enclosure of claim 12 wherein said ceiling assembly and said panel assembly are arcuate shaped.

18. The phone enclosure of claim 4 wherein said first end and said second end of said second rail, said first end and said second end of said third rail, said first end of said fourth rail and said first end of said first rail have complementary angled edges, and said second end of said fourth rail and said second end of said first rail have complementary flat edges.

19. The phone enclosure of claim 18 wherein said first rail is L-shaped.

20. A telephone enclosure comprising a back panel, curved sidewalls attached to said back panel which, together with said back panel, horizontally cover at least 180°, leaving an open front access to the enclosure, a ceiling assembly attached to said sidewalls, said ceiling assembly comprising a substantially circular top plate, a similar substantially circular bottom plate spaced vertically from said top plate, said plates forming a compartment therebetween, a light source positioned within said compartment, and an opening in said bottom plate to permit light to pass from said top enclosure to the main interior of the telephone enclosure formed by the curved sidewalls, said sidewalls comprising:

an acoustic housing having an outer panel;

an inner panel;

an acoustic insulation panel; and a body rail assembly, said body rail assembly comprising a first rail having a first rail base with an integral first leg, an integral second leg, an integral third leg and an integral fourth leg depending therefrom, said first leg positioned in spaced relation to said second leg and defining a first rail inner panel receiving slot therebetween, said third leg positioned in spaced relation to said fourth leg and defining a first rail outer panel receiving slot, said inner panel slideably received by said first rail inner panel receiving slot and said outer panel slideably received by said outer panel receiving slot, said first rail also having a first rail insulation receiving step integral to and depending from said first rail base, said step positioned between said second leg and said third leg wherein a first recess is defined between said second leg and said first rail step and a second recess is defined between said first rail step and said third leg wherein a first edge of said insulation panel abuts against said step and a first air gap is defined between said inner panel and said insulation panel and a second air gap is defined between said insulation panel and said outer panel.

* * * * *